US010955201B2

(12) United States Patent
Yamasaki

(10) Patent No.: US 10,955,201 B2
(45) Date of Patent: Mar. 23, 2021

(54) HEAT EXCHANGER, BOILER, AND SETTING METHOD FOR HEAT EXCHANGER

(71) Applicant: Mitsubishi Hitachi Power Systems, Ltd., Kanagawa (JP)

(72) Inventor: Yoshinori Yamasaki, Kanagawa (JP)

(73) Assignee: MITSUBISHI POWER, LTD., Kanagawa (JP)

( * ) Notice: Subject to any disclaimer, the term of this patent is extended or adjusted under 35 U.S.C. 154(b) by 133 days.

(21) Appl. No.: 16/256,256

(22) Filed: Jan. 24, 2019

(65) Prior Publication Data

US 2019/0226774 A1 Jul. 25, 2019

(30) Foreign Application Priority Data

Jan. 25, 2018 (JP) ..... 2018-010685

(51) Int. Cl.
*F28D 1/04* (2006.01)
*F28F 13/06* (2006.01)
(Continued)

(52) U.S. Cl.
CPC ..... *F28F 13/06* (2013.01); *F22B 1/1869* (2013.01); *F28D 7/085* (2013.01); *F28F 1/12* (2013.01); *F28F 2250/02* (2013.01)

(58) Field of Classification Search
CPC ..... F28D 1/0477; F28D 7/085; F28D 7/087; F28D 7/00; F28D 7/082; F22B 1/1869; F22B 1/18; F22B 31/08; F28F 1/12; F28F 1/14; F28F 13/06; F28F 19/00; F28F 2215/04; F28F 2215/10; F28F 2250/00;
(Continued)

(56) References Cited

U.S. PATENT DOCUMENTS 5,853,047 A 12/1998 Kim
2017/0229375 A1* 8/2017 Haj-Hariri ..... H01L 23/427
(Continued)

FOREIGN PATENT DOCUMENTS

CN 103967199 8/2014
CN 204534641 8/2015
(Continued)

OTHER PUBLICATIONS

Office Action dated Dec. 26, 2019 in Chinese Patent Application No. 201910070912.9, with English-language translation.

*Primary Examiner* — Henry T Crenshaw
*Assistant Examiner* — Kamran Tavakoldavani
(74) *Attorney, Agent, or Firm* — Wenderoth, Lind & Ponack, L.L.P.

(57) ABSTRACT

The present invention provides an economizer 70 including a plurality of cylindrical heat transfer tubes 71*a*-71*d* extending along a crossing direction crossing a flowing direction of combustion gas and disposed at a predetermined disposition interval P along the flowing direction, the combustion gas and fluid flowing in the plurality of heat transfer tubes performing heat exchange, and a swirl preventing section 75 disposed in contact with a downstream side outer circumferential surface 71Aa-71Ad in the flowing direction of each of the plurality of heat transfer tubes 71*a*-71*d* and configured to prevent a swirl of the combustion gas from occurring near the downstream side outer circumferential surface 71Aa-71Ad.

9 Claims, 8 Drawing Sheets

(51) Int. Cl.

| | |
|---|---|
| ***F28D 7/08*** | (2006.01) |
| ***F28F 1/12*** | (2006.01) |
| ***F22B 1/18*** | (2006.01) |

(58) Field of Classification Search
CPC ..... F28F 2250/02; F28F 9/013; F28F 9/0131; F28F 13/02; F22G 1/02
See application file for complete search history.

(56) References Cited

U.S. PATENT DOCUMENTS

| | | | | |
|---|---|---|---|---|
| 2018/0058772 | A1* | 3/2018 | Baker | F28D 1/024 |
| 2018/0135915 | A1* | 5/2018 | Kester | F28F 9/0275 |

FOREIGN PATENT DOCUMENTS

| | | | | |
|---|---|---|---|---|
| CN | 205980918 | | 2/2017 | |
| CN | 107401946 | * | 6/2017 | F28F 1/12 |
| CN | 107401946 A | * | 6/2017 | F28F 1/12 |
| CN | 107401946 | | 11/2017 | |
| JP | 60-181591 | | 9/1985 | |
| JP | 3-61081 | | 9/1991 | |
| JP | 4-5848 | | 2/1992 | |
| JP | 10-141883 | | 5/1998 | |
| JP | 5652072 | | 1/2015 | |
| JP | 2017-44394 | | 3/2017 | |

* cited by examiner

HEAT EXCHANGER, BOILER, AND SETTING METHOD FOR HEAT EXCHANGER

TECHNICAL FIELD

The present invention relates to a heat exchanger, a boiler, and a setting method for the heat exchanger.

BACKGROUND ART

There has been known a boiler in which various heat exchangers such as a superheater, a re-heater, and an economizer are set in order from a furnace side (see, for example, Patent Literature 1). The boiler disclosed in Patent Literature 1 is a coal-fired boiler. The boiler generates high-temperature and high-pressure steam through heat exchange between water or steam passing through the insides of the various heat exchangers and combustion gas.

CITATION LIST

Patent Literature

[PTL 1] Japanese Unexamined Patent Application, Publication No. 2017-44394

SUMMARY OF INVENTION

Technical Problem

Coal fuel has advantages in a reserve, a market price, transportability, and the like. However, fuel crushing equipment is necessary because the coal fuel is solid under normal temperature and normal pressure. Since more nitrogen oxide and sulfur oxide are included in exhaust gas per heat value compared with combustible gas such as natural gas, ash treatment equipment, desulfurization equipment, and dust collection equipment are large compared with a gas-fired boiler. Therefore, costs for operation and maintenance of these kinds of equipment are necessary.

For improvement of operability, some coal-fired boiler is remodeled into a gas-fired boiler that uses combustible gas as fuel. In this case, a heat exchanger configured by a large number of heat transfer tubes to mainly perform convective heat transfer is designed according to the temperature inside a boiler furnace that burns coal. However, when the combustible gas is used as the fuel, radiation intensity generated from the combustion gas decreases compared with radiation intensity during coal combustion and the temperature inside the boiler furnace rises. Therefore, a heat absorption amount by the convective heat transfer from the combustion gas of the heat exchanger is excessively large.

As measures against this problem, for example, it is possible to reduce the heat absorption amount from the combustion gas of the heat exchanger by reducing a heat transfer area, such as reducing the total length of the heat transfer tubes. However, in remodeling of the heat exchanger, a lot of manhour is required for remodeling of the boiler because of work for discharging boiler water on the insides of the heat transfer tubes and work such as cutting and welding and a withstanding pressure test of the heat transfer tubes. It is difficult to accurately design a necessary heat transfer area because of the soil remained in the heat transfer tubes. If the heat transfer tubes are remodeled, for example, it is difficult to thereafter re-correct the heat transfer area. Therefore, there is a demand for measures with simple remodeling.

The present invention has been devised in view of such circumstances, and an object of the present invention is to provide a heat exchanger, a boiler, and a setting method for the heat exchanger capable of reducing a heat absorption amount from combustion gas without requiring a lot of manhour.

Solution to Problem

In order to solve the problems, the present invention adopts the following means.

A heat exchanger according to an aspect of the present invention includes: a plurality of cylindrical heat transfer tubes extending along a crossing direction crossing a flowing direction of combustion gas and disposed at a predetermined disposition interval along the flowing direction, the combustion gas and fluid flowing in the plurality of heat transfer tubes performing heat exchange; and a swirl preventing section disposed in contact with a downstream side outer circumferential surface of each of the plurality of heat transfer tubes and configured to prevent a swirl of the combustion gas from occurring near the downstream side outer circumferential surface.

With the heat exchanger according to the aspect of the present invention, since the swirl preventing section is disposed in contact with the downstream side outer circumferential surface in the flowing direction of the combustion gas in each of the plurality of heat transfer tubes, a phenomenon in which a swirl occurs on the downstream side of the heat transfer tube when the combustion gas passes through the heat transfer tube is prevented. Therefore, on the downstream side outer circumferential surface of the heat transfer tube, it is possible to reduce a heat absorption amount due to heat transfer of heat of the combustion gas to fluid such as water or steam flowing in the heat transfer tube.

In the heat exchanger according to the aspect of the present invention, the predetermined disposition interval may be 1.5 times or more an outer diameter of the heat transfer tube.

When the disposition interval in the flowing direction of the plurality of heat transfer tubes is 1.5 times or more the outer diameter of the heat transfer tube, heat transfer between the combustion gas in the heat transfer tube and the fluid flowing in the heat transfer tube is performed mainly by convective heat transfer. Therefore, a phenomenon in which a swirl occurs on the combustion gas downstream side of the heat transfer tube when the combustion gas passes through the heat transfer tube is prevented by a plurality of the swirl preventing sections. Consequently, it is possible to reduce a heat absorption amount due to heat transfer between the combustion gas and the fluid flowing in the heat transfer tube.

In the heat exchanger according to the aspect of the present invention, the swirl preventing section may be disposed in contact with the downstream side outer circumferential surface in a range of 120° or more and 180° or less centering on a downstream side end portion in the flowing direction of the heat transfer tube in a circumferential direction around a longitudinal direction center axis of the heat transfer tube.

By setting the range in which the swirl preventing section is in contact with the downstream side outer circumferential surface of the heat transfer tube to 120° or more, the phenomenon in which a swirl occurs on the downstream side of the heat transfer tube when the combustion gas passes through the heat transfer tube is effectively prevented. By setting the range in which the swirl preventing section is in contact with the downstream side outer circumferential surface of the heat transfer tube to 180° or less, it is possible to prevent a heat absorption amount of the heat exchanger from excessively decreasing and prevent a pressure loss at the time when the combustion gas flows from increasing because a disposition interval between the heat transfer tube and the other plurality of heat transfer tubes disposed adjacent to the heat transfer tube is excessively narrowed.

In the heat exchanger according to the aspect of the present invention, the swirl preventing section is disposed in contact with both of a downstream side outer circumferential surface of a first one of the heat transfer tubes disposed on an upstream side in the flowing direction and an upstream side outer circumferential surface of a second one of the heat transfer tubes disposed adjacent to a downstream side in the flowing direction of the first heat transfer tube.

Since the swirl preventing section is disposed to fill a gap in the flowing direction of the combustion gas between the first heat transfer tube and the second heat transfer tube, it is possible to set the swirl preventing section with relatively easy setting work.

In the heat exchanger according to the aspect of the present invention, the swirl preventing section may be configured to include a fireproof material including at least any one of $SiO_2$, $Al_2O_3$, and SiC.

With the heat exchanger having this configuration, by using the fireproof material including $SiO_2$, $Al_2O_3$, or SiC excellent in heat resistance and abrasion resistance and generally used, it is possible to form the swirl preventing section with a material relatively inexpensive and having durability against the combustion gas.

In the heat exchanger having the configuration, the heat exchanger may be formed to include a holding section disposed between a pair of the heat transfer tubes, which is disposed adjacent to each other in the flowing direction, and configured to hold the fireproof material.

With the heat exchanger having the form, by holding the heat proof material with the holding section, it is possible to facilitate working of the fireproof material and prevent the fireproof material from peeling from the heat transfer tube because of aged deterioration or the like.

In the heat exchanger having the form, the holding section may include a first bar-like member made of metal, both end portions of which are welded to the pair of heat transfer tubes, and a second bar-like member made of metal welded to the first bar-like member and disposed to cross the first bar-like member.

By disposing the first bar-like member and the second bar-like member in a crossing manner, it is possible to appropriately hold the fireproof material in a gap between the pair of heat transfer tubes. Since both the end portions of the first bar-like member are welded to the pair of heat transfer tubes and heat transfer from the first bar-like member to the pair of heat transfer tubes is possible, it is possible to prevent the holding section from being burned by heat of the combustion gas.

In the heat exchanger according to the aspect of the present invention, the swirl preventing section may be a tube body extending in a longitudinal axial direction of the heat transfer tube along the crossing direction.

By disposing the tube body in the longitudinal axial direction of the heat transfer tube while being set in contact with the downstream side outer circumferential surface in the combustion gas flowing direction of the heat transfer tube, a phenomenon in which a swirl occurs on an immediately downstream side of the heat transfer tube when the combustion gas passes through the heat transfer tube is prevented.

A boiler according to an aspect of the present invention includes the heat exchanger according to the aspect described above that performs the heat exchange with combustion gas generated in a furnace.

With the boiler according to the aspect, it is possible to reduce a heat absorption amount from the combustion gas without requiring a lot of manhour.

A setting method for a heat exchanger according to an aspect of the present invention includes: disposing, along a flowing direction of combustion gas, at a predetermined disposition interval, a plurality of cylindrical heat transfer tubes extending along a crossing direction crossing the flowing direction of the combustion gas, the combustion gas and fluid flowing in the plurality of heat transfer tubes performing heat exchange; and disposing, in contact with a downstream side outer circumferential surface in the flowing direction of each of the plurality of heat transfer tubes, a swirl preventing section configured to prevent a swirl of the combustion gas from occurring near the downstream side outer circumferential surface.

With the setting method for the heat exchanger according to the aspect of the present invention, since the swirl preventing section is disposed in contact with the downstream side outer circumferential surface in the flowing direction of the combustion gas in each of the plurality of heat transfer tubes, a phenomenon in which a swirl occurs on the downstream side of the heat transfer tube when the combustion gas passes through the heat transfer tube is prevented. Therefore, it is possible to reduce a heat absorption amount due to heat transfer of heat of the combustion gas from the downstream side outer circumferential surface of the heat transfer tube to fluid such as water or steam flowing in the heat transfer tube.

Advantageous Effects of Invention

According to the present invention, it is possible to provide a heat exchanger, a boiler, and a setting method for the heat exchanger capable of reducing a heat absorption amount from combustion gas without requiring a lot of manhour.

DESCRIPTION OF EMBODIMENTS

First Embodiment

A boiler 10 according to a first embodiment of the present invention is explained below with reference to the drawings.

Figure 1:
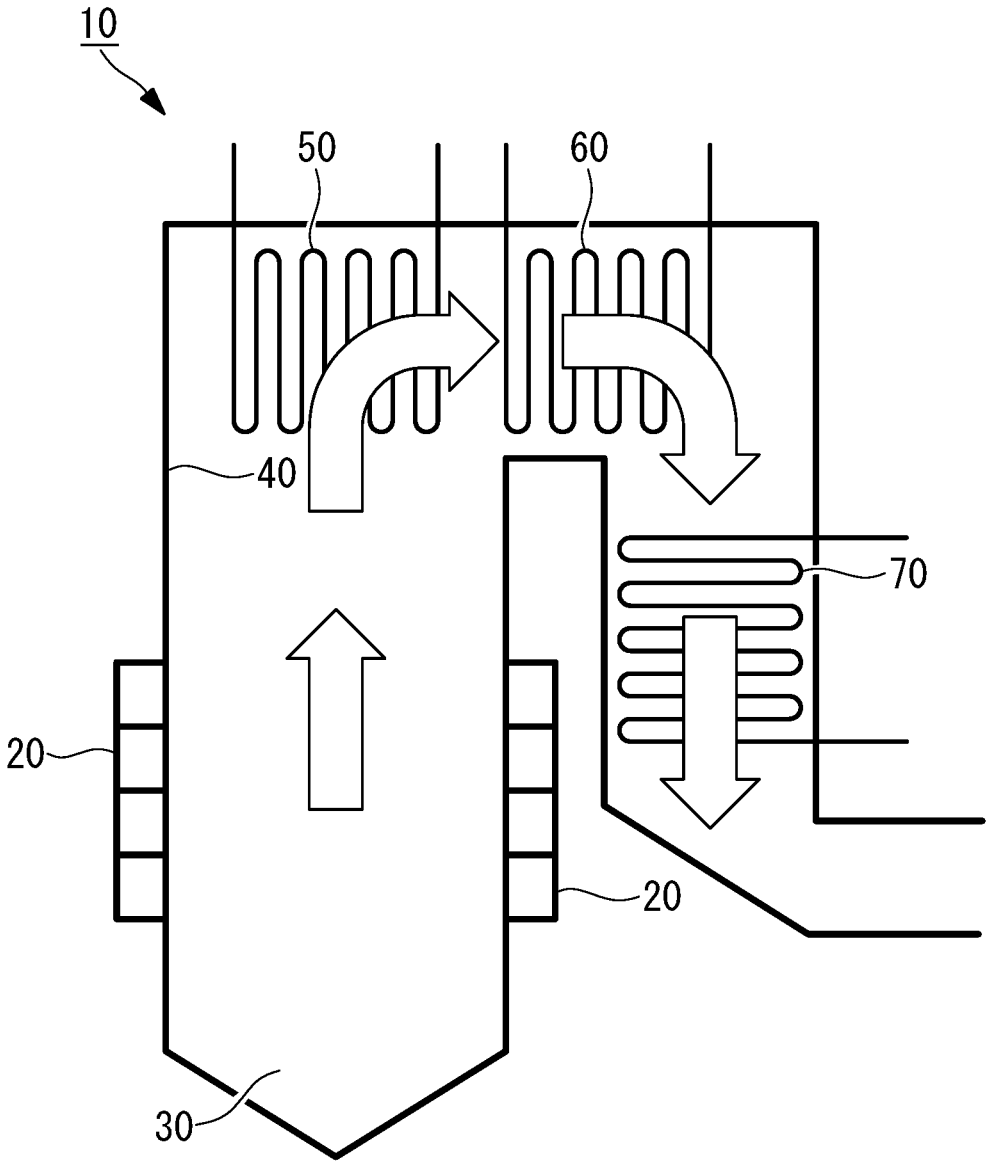
FIG. 1 is a longitudinal sectional view showing a boiler in a first embodiment.

The boiler 10 in this embodiment is a gas-fired boiler that burns combustible gas such as natural gas as fuel. As shown in FIG. 1, the boiler 10 in this embodiment includes a furnace 30 in which a burner 20 is set and a flue 40 (a combustion gas passage) extending from the furnace 30 and configured to cause combustion gas generated in the furnace 30 to flow. A furnace wall pipe (not shown in FIG. 1) is disposed on wall surfaces of the furnace 30 and the flue 40. Water flowing in the furnace wall pipe is heated by the combustion gas flowing in the flue 40 to change to steam.

In the flue 40, for example, various heat exchangers including a superheater 50, a re-heater 60, and an economizer 70 are set in order along a flowing direction of the combustion gas from the furnace 30 side. Water or steam passing through the insides of the heat exchangers exchanges heat with the combustion gas flowing in the flue 40, whereby high-temperature and high-pressure steam is generated.

The economizer 70 is explained in detail with reference to FIGS. 2 and 3.

Figure 2:
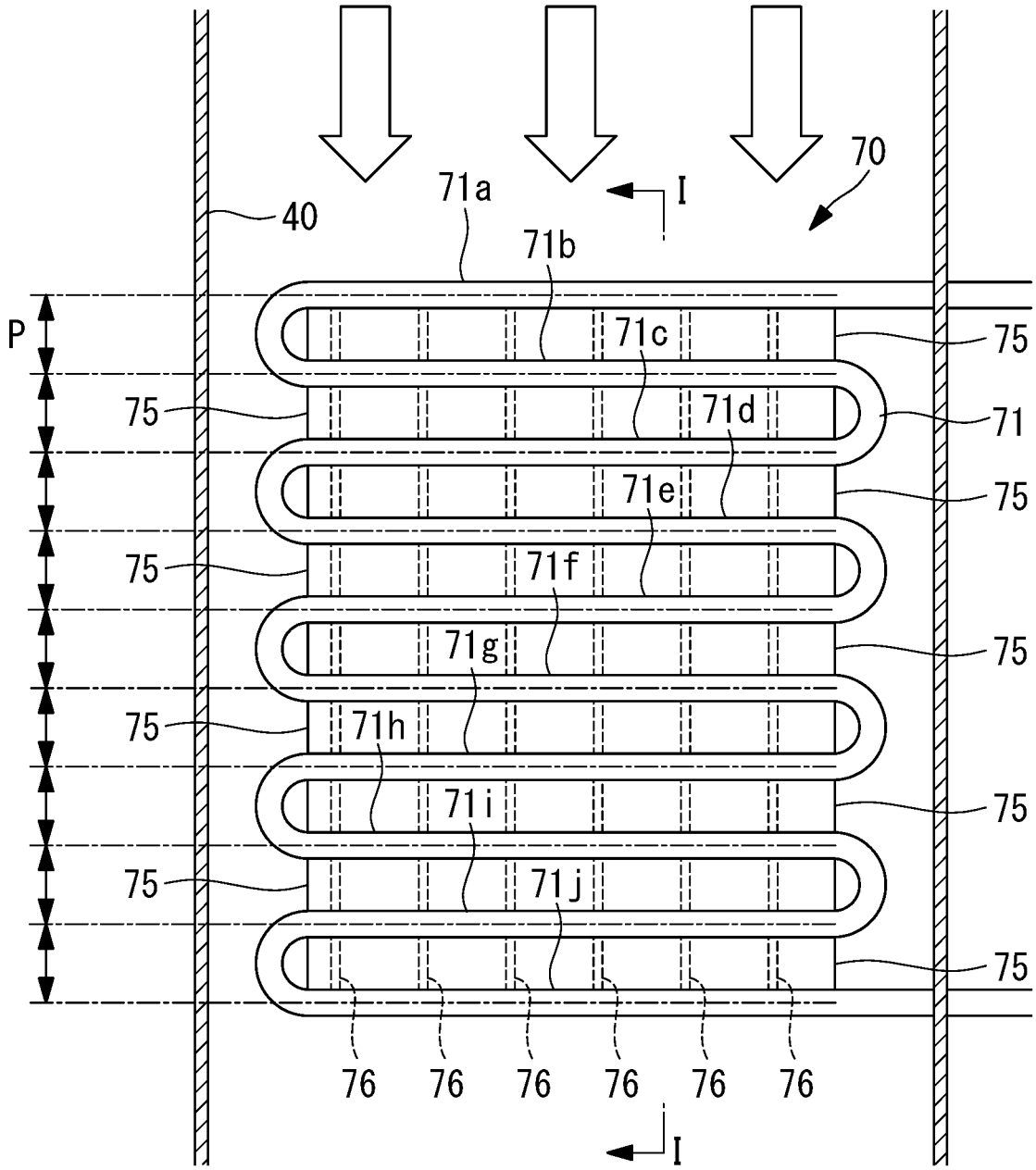
FIG. 2 is a partially enlarged view of an economizer shown in FIG. 1.

FIG. 2 is a partially enlarged view of the economizer 70 shown in FIG. 1. FIG. 3 is a I-I arrow sectional view of the economizer 70 shown in FIG. 2.

In FIG. 2, in the flue 40 in which the economizer 70 is set, the combustion gas passes from a vertical upward direction (an upstream side) toward a vertical downward direction (a downstream side). In this embodiment, in the economizer 70, heat transfer tube panels 71, 72, and 73, on which pluralities of heat transfer tubes extending in the horizontal direction are arrayed in a meandering shape and a planar shape from the downstream side of the flue 40 (the vertical downward direction in FIG. 2) toward the upstream side (the vertical upward direction in FIG. 2), are disposed side by side in a direction perpendicular to the paper surface of FIG. 2.

As shown in FIG. 2, the heat transfer tube panel 71 of the economizer 70 in this embodiment includes a plurality of heat transfer tubes 71*a*, 71*b*, 71*c*, 71*d*, 71*e*, 71*f*, 71*g*, 71*h*, 71*i*, and 71*j* (hereinafter referred to as heat transfer tubes 71*a* to 71*j*) extending along a crossing direction crossing the vertical direction, which is the flowing direction of the combustion gas. The plurality of heat transfer tubes 71*a* to 71*j* are cylindrical tube bodies made of metal (e.g., low alloy steel or stainless steel) disposed at a fixed disposition interval P along the flowing direction of the combustion gas. The disposition interval P is desirably set to 1.5 times or more an outer diameter D of the heat transfer tubes 71*a* to 71*j*.

The combustion gas that is exchanged heat by the economizer 70 is combustion gas in a relatively intermediate temperature region of, for example, 450° C. or less, after be exchanged heat by the superheater 50 and the re-heater 60. Therefore, it is desirable to perform, mainly as convective heat transfer, heat transfer between fluid such as water or steam flowing in the heat transfer tubes 71*a* to 71*j* of the heat transfer tube panel 71 of the economizer 70 and the combustion gas. A relation between the disposition interval P and the outer diameter D of the heat transfer tubes 71*a* to 71*j* changes with respect to a heat transfer state between the fluid flowing in the heat transfer tubes 71*a* to 71*j* and the combustion gas.

When the disposition interval P is approximately 1.0 time the outer diameter D, since the convective heat transfer is not effectively performed, radiation heat transfer is relatively mainly performed. However, by setting the disposition interval P to 1.5 times or more the outer diameter D, the convective heat transfer is mainly performed and the heat transfer is efficiently performed.

On the other hand, it is undesirable to set the disposition interval P to 2.5 times or more the outer diameter D because the height of the heat transfer tube panel 71 increases and the economizer 70 becomes excessively large and cannot be set in the flue 40 because of a spatial problem.

It is undesirable to reduce the number of the heat transfer tubes 71*a* to 71*j* in order to not change the height of the heat transfer tube panel 71 because a heat transfer area decreases and a requested heat absorption amount cannot be secured. The heat transfer between the fluid flowing in the heat transfer tubes 71*a* to 71*j* and the combustion gas is performed mainly as the convective heat transfer. Consequently, as explained below, it is possible to reduce, with swirl preventing sections 75, a heat absorption amount from the combustion gas.

Figure 3:
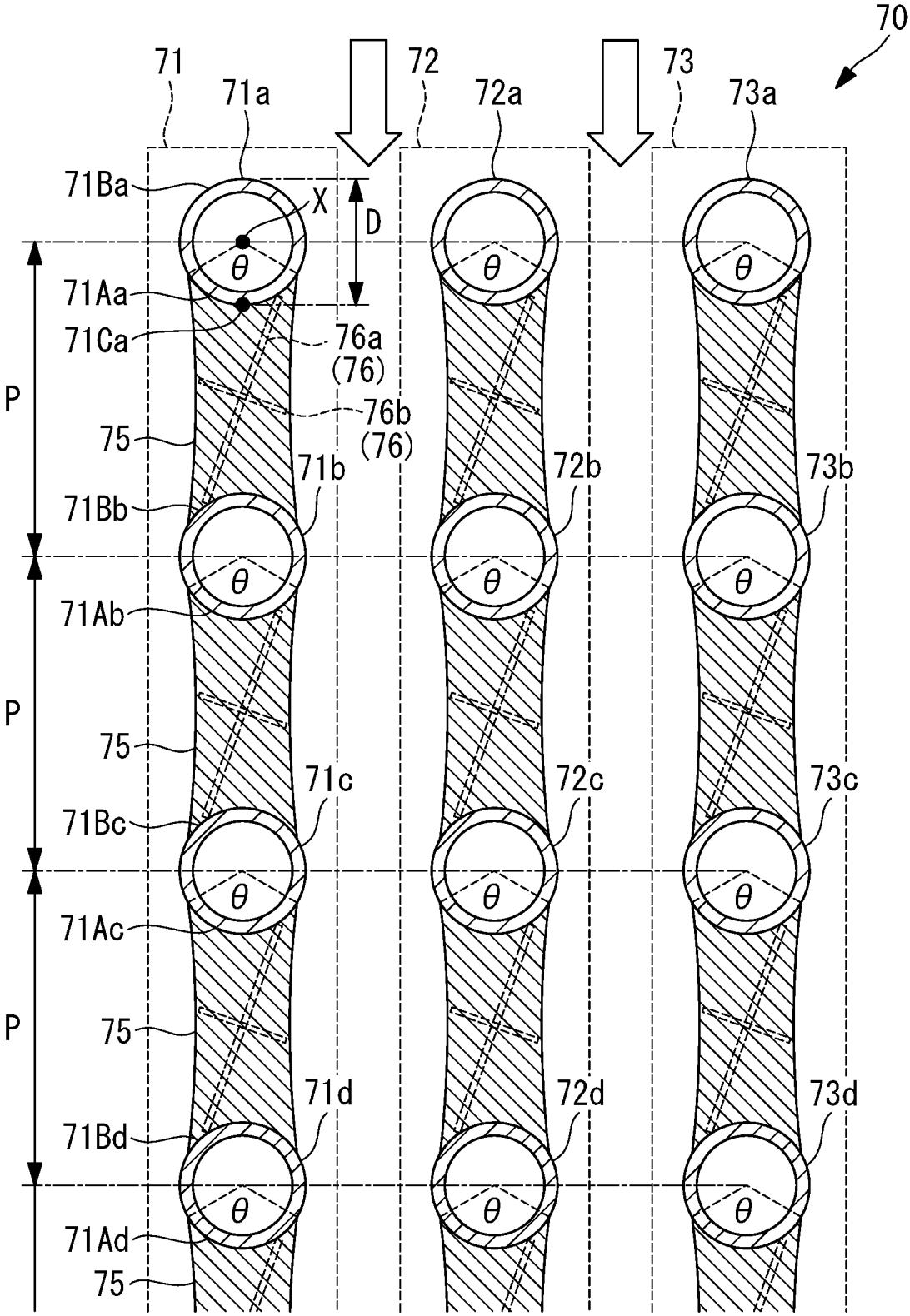
FIG. 3 is a I-I arrow sectional view of the economizer shown in FIG. 2.

As shown in FIG. 3, the heat transfer tube panel 72 includes a plurality of heat transfer tubes including a plurality of heat transfer tubes 72*a*, 72*b*, 72*c*, and 72*d* extending along the crossing direction. The heat transfer tube panel 73 includes a plurality of heat transfer tubes including a plurality of heat transfer tubes 73*a*, 73*b*, 73*c*, and 73*d* extending along the crossing direction. The heat transfer tube panels 71, 72, and 73 form a single channel formed by coupling a plurality of heat transfer tubes. For example, the heat transfer tube panels 71, 72, and 73 are arrayed in a meandering shape and a planar shape from the downstream side of the combustion gas (the vertical downward direction in FIG. 3) toward the upstream side of the combustion gas (the vertical upward direction in FIG. 3).

A plurality of swirl preventing sections 75 that prevent a swirl from occurring in the combustion gas flow near outer circumferential surfaces 71Aa, 71Ab, 71Ac, and 71Ad on the downstream side of the combustion gas are disposed among the plurality of heat transfer tubes 71*a* to 71*j*. As shown in FIG. 3, the swirl preventing section 75 is disposed in contact with both of the downstream side outer circumferential surface 71Aa of the heat transfer tube 71*a* disposed on the upstream side in the combustion gas flowing direction and an upstream side outer circumferential surface 71Bb of the heat transfer tube 71*b* disposed adjacent to the downstream side in the combustion gas flowing direction of the heat transfer tube 71*a*.

Similarly, the swirl preventing section 75 is disposed in contact with both of the downstream side outer circumferential surface 71Ab of the heat transfer tube 71*b* disposed on the upstream side in the combustion gas flowing direction and an upstream side outer circumferential surface 71Bc of the heat transfer tube 71*c* disposed adjacent to the downstream side in the combustion gas flowing direction of the heat transfer tube 71*b*. Similarly, the swirl preventing section 75 is disposed in contact with both of the downstream side outer circumferential surface 71Ac of the heat transfer tube 71*c* disposed on the upstream side in the combustion gas flowing direction and an upstream side outer circumferential surface 71Bd of the heat transfer tube 71*d* disposed adjacent to the downstream side in the combustion gas flowing direction of the heat transfer tube 71*c*.

The swirl preventing section 75 shown in FIG. 3 is, for example, a fireproof material formed by working and drying a clay-like material of a ceramic material including at least any one of $SiO_2$, $Al_2O_3$, and SiC. The clay-like material is baked by causing the combustion gas to flow through the clay-like material after the drying and formed into the swirl preventing section 75 excellent in heat resistance and abrasion resistance. The swirl preventing section 75 is disposed in contact with the downstream side outer circumferential surface 71Aa in a working range θ centering on a downstream side end portion 71Ca in the combustion gas flowing direction of the heat transfer tube 71*a* in a circumferential direction around a longitudinal direction center axis X of the heat transfer tube 71*a*. The heat transfer tube 71*a* is explained above. However, the same applies to the other heat transfer tubes.

Figure 4:
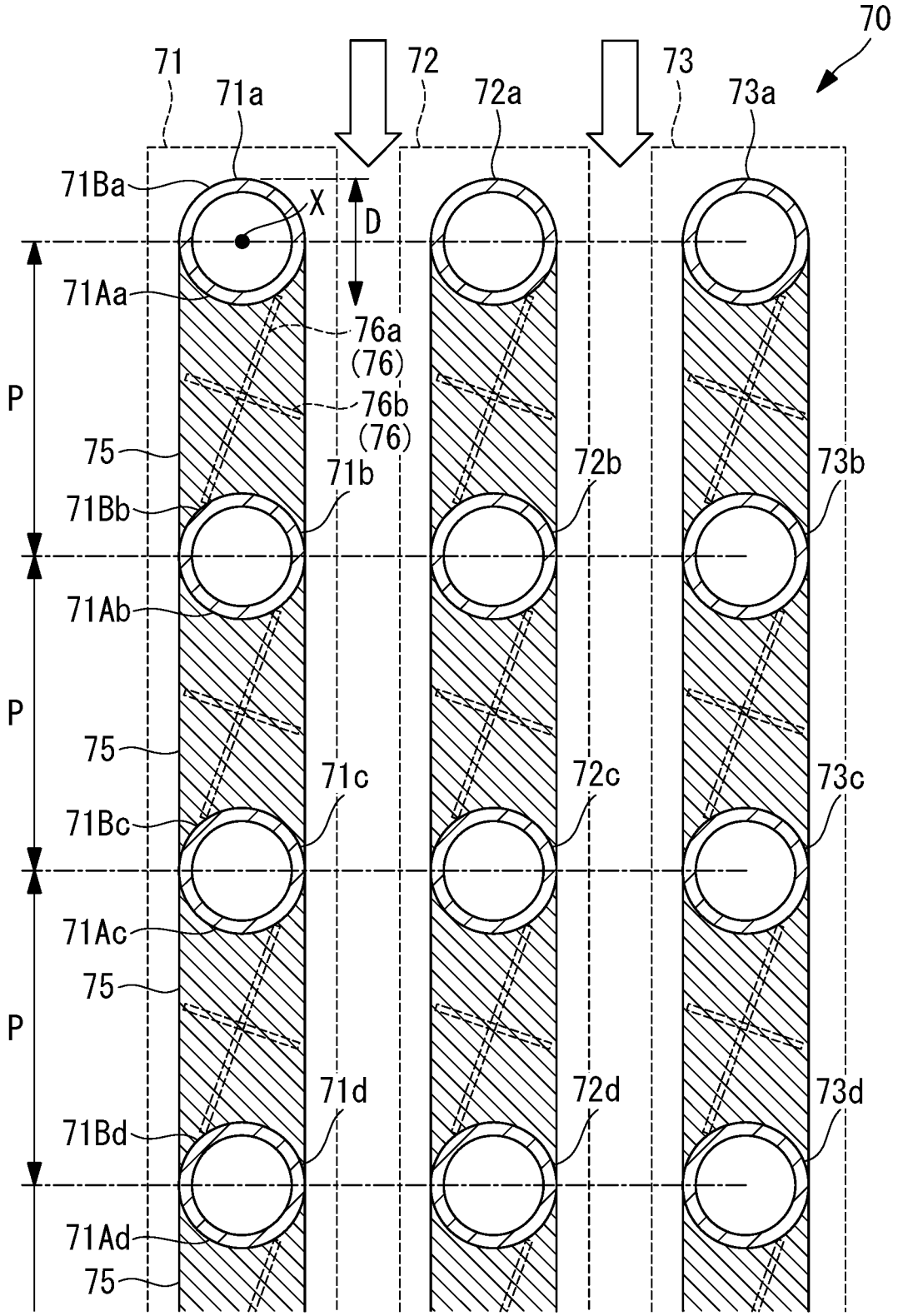
FIG. 4 is a sectional view showing a modification of the economizer shown in FIG. 3.

FIG. 3 shows an example in which the working range θ is set to 120°. On the other hand, a modification of the economizer 70 shown in FIG. 4 is an example in which the working range θ is set to 180°. In this embodiment, an angle of 120° or more or 180° or less is set as the working range θ. A reason why the working range θ is set to 120° or more or 180° or less is explained.

Figure 5:
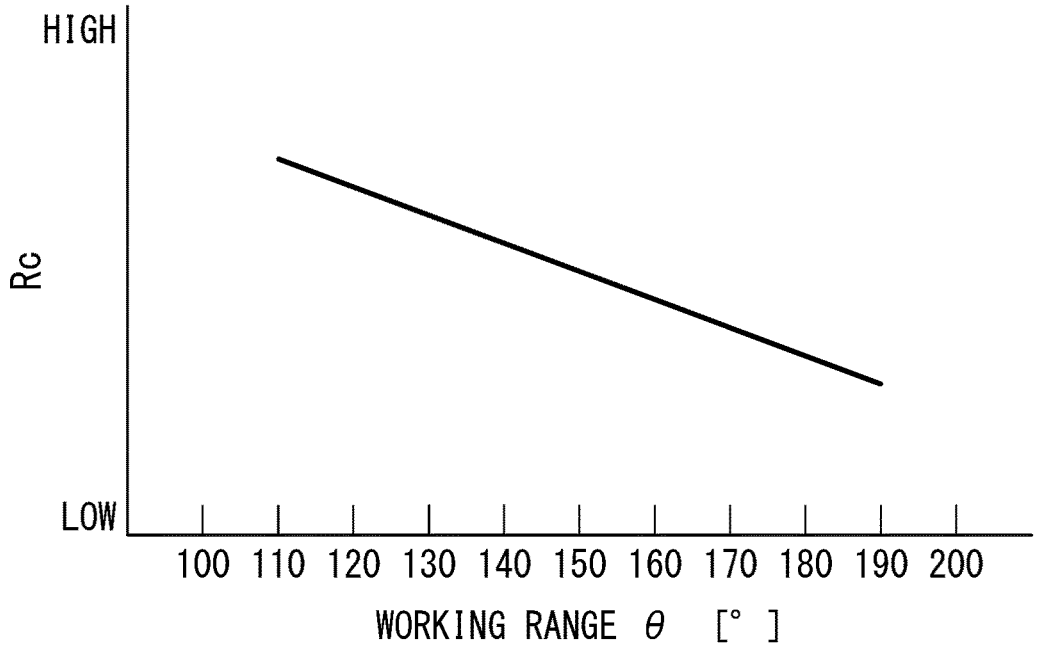
FIG. 5 is a diagram showing a relation between a working range of a swirl preventing section and a convective heat transfer coefficient.

FIG. 5 is a diagram showing a relation between the working range of the swirl preventing section 75 and a convective heat transfer coefficient Rc.

When the heat transfer tubes 71*a* to 71*j* are set in a direction orthogonal to the flowing direction of the combustion gas, a heat absorption amount Q of the heat transfer tubes 71*a* to 71*j* is represented by the following Expression (1).

$$Q=S\sim Rc\sim \mathrm{LMTD} \quad (1)$$

S represents an effective heat transfer area, Rc represents a convective heat transfer coefficient, and LMTD represents a log-mean temperature difference between the combustion gas and water or steam. When it is desired to reduce the heat absorption amount Q of the heat transfer tubes 71*a* to 71*j*, the effective heat transfer area S only has to be reduced. However, remodeling for reducing the number and the length of the heat transfer tubes 71*a* to 71*j* is necessary. Once the remodeling is performed, it is difficult to re-correct the effective heat transfer area later. Therefore, in this embodiment, the heat absorption amount Q of the heat transfer tubes 71*a* to 71*j* is reduced by reducing the convective heat transfer coefficient Rc without changing the effective heat transfer area S of the heat transfer tubes 71*a* to 71*j*. As shown in FIG. 5, the convective heat transfer coefficient Rc decreases as the working range θ is increased. The heat absorption amount Q of the heat transfer tubes 71*a* to 71*j* also decreases according to the decrease in the convection the transfer coefficient Rc.

Figure 6:
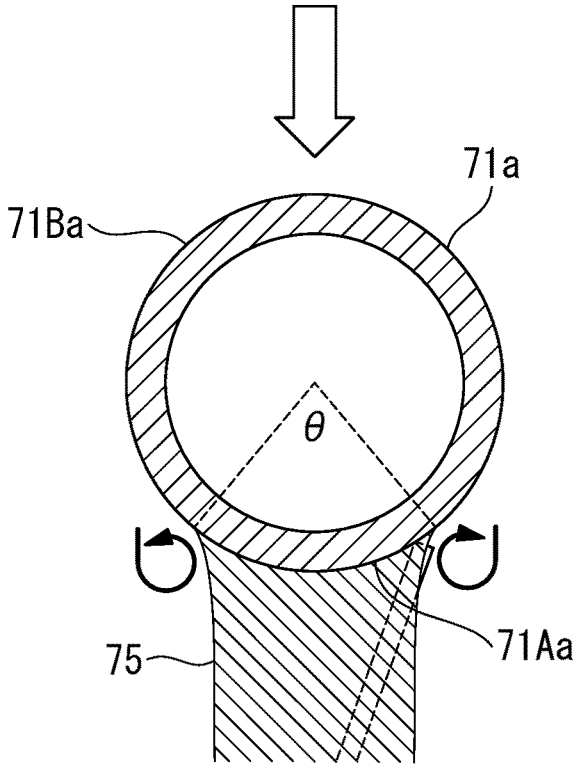
FIG. 6 is a partially enlarged view showing a heat transfer tube and the swirl preventing section.

FIG. 6 is a diagram showing the heat transfer tube 71*a* and the swirl preventing section 75. FIG. 6 shows an example in which the working range θ is set narrower than 120°. As shown in FIG. 6, when the working range θ is set narrower than 120°, the convective heat transfer coefficient Rc increases. The heat absorption amount Q of the heat transfer tubes 71*a* to 71*j* also increases according to the increase in the convective heat transfer coefficient Rc.

Since a swirl that facilitates heat transfer occurs in the combustion gas downstream side of the heat transfer tube when the combustion gas passes through the heat transfer tube, the downstream side outer circumferential surface 71Aa of the heat transfer tube 71*a* changes to a turbulence region. It is possible to successively perform heat transfer with the combustion gas having high temperature. Therefore, the convective heat transfer coefficient Rc of the fluid flowing in the heat transfer tube 71*a* and the combustion gas, via the downstream side outer circumferential surface 71Aa of the heat transfer tube 71*a* increases.

As shown in FIG. 5, as the working range θ is set narrower, an occurrence frequency of the swirl that facilitates the heat transfer of the combustion gas starts to increase on the paper surface right side or left side of the downstream end portion in the combustion gas flowing direction of the heat transfer tube 71*a*. The convective heat transfer coefficient Rc increases. Further, as shown in FIG. 6, when the working range θ is set narrower than 120°, the occurrence frequency of the swirl that facilitates the heat transfer of the combustion gas increases on both the paper surface right side and left side of the downstream end portion in the combustion gas flowing direction of the heat transfer tube 71*a*. A swirl of the combustion gas indicated by an arrow on the combustion gas downstream side of the heat transfer tube 71*a* more easily occurs.

Figure 7:
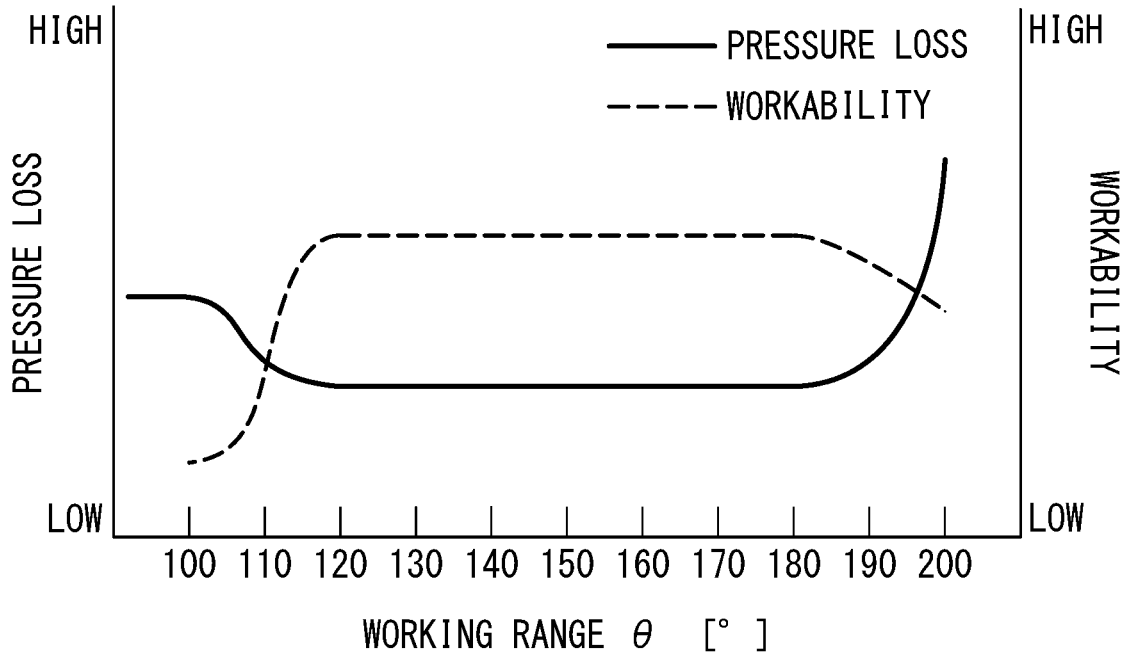
FIG. 7 is a diagram showing a relation between the working range of the swirl preventing section and a pressure loss and workability of the swirl preventing section.

As explained above, the heat absorption amount Q of the heat transfer tubes 71*a* to 71*j* decreases when the working range θ is set wide. However, a pressure loss of the combustion gas and workability of the swirl preventing section 75 also need to be considered. FIG. 7 is a diagram showing a relation between the working range of the swirl preventing section 75 and the pressure loss and the workability. In FIG. 7, a solid line indicates a relation between the working range θ and a pressure loss of the combustion gas flowing in the economizer 70.

When the working range θ is set narrower than 120°, since a swirl of the combustion gas occurs in one layer on the combustion gas downstream side of the heat transfer tube 71*a* explained above, the swirl acts as resistance against the flowing of the combustion gas. Therefore, a large pressure loss occurs in the combustion gas flowing between the heat transfer tube panel 71 and the heat transfer tube panel 72 and between the heat transfer tube panel 72 and the heat transfer tube panel 73. When the working range θ is set wider than 180°, an interval between the heat transfer tube panel 71 and the heat transfer tube panel 72 and an interval between the heat transfer tube panel 72 and the heat transfer tube panel 73 are narrowed. Therefore, a channel of the combustion gas flowing between the heat transfer tube panel 71 and the heat transfer tube panel 72 and between the heat transfer tube panel 72 and the heat transfer tube panel 73 is narrowed. A large pressure loss occurs.

In FIG. 7, a broken line indicates a relation between the working range θ and workability in working the swirl preventing section 75 on the economizer 70.

In the working of the swirl preventing section 75, a fireproof material is formed from a clay-like ceramic material including at least any one of $SiO_2$, $Al_2O_3$, and SiC. When the working range θ is set narrower than 120°, it is necessary to work the swirl preventing section 75 at extremely small thickness. Therefore, the workability decreases. When the working range θ is set wider than 180°, it is necessary to work the swirl preventing section 75 at extremely large thickness. Therefore, the workability decreases.

As explained above, when the working range θ is set narrower than 120° or wider than 180°, the pressure loss increases and the workability of the swirl preventing section 75 decreases. Therefore, it is desirable to set the working range θ to 120° or more and 180° or less.

The economizer 70 in this embodiment includes a holding section (a stud) 76 disposed between a pair of heat transfer tubes (e.g., the heat transfer tube 71*a* and the heat transfer tube 71*b*) disposed adjacent to each other in the combustion gas flowing direction and configured to hold the fireproof material. As shown in FIG. 3, the holding section 76 includes a first bar-like member 76*a* made of metal (e.g., low alloy steel or stainless steel), both end portions of which are welded to the heat transfer tube 71*a* and the heat transfer tube 71*b*, and a second bar-like member 76*b* welded to the first bar-like member 76*a* and disposed to cross the first bar-like member 76*a*. As shown in FIG. 2, a plurality of the holding sections 76 are disposed in a plurality of parts along the crossing direction in which the heat transfer tubes extend. The fireproof material formed from the ceramic material is firmly attached around the first bar-like member 76*a* and the second bar-like member 76*b*, whereby the holding section 76 holds the swirl preventing section 75.

A setting method for the economizer 70 in this embodiment is explained.

First, as shown in FIG. 2, the plurality of heat transfer tubes 71*a* to 71*j* are disposed at the disposition interval P along the combustion gas flowing direction. An operator couples the plurality of heat transfer tubes 71*a* to 71*j* to form a single channel.

Second, the plurality of swirl preventing sections 75 that prevent a swirl that facilitates heat transfer of the combustion gas from occurring are disposed near downstream side outer circumferential surfaces in the combustion gas flowing direction of the respective plurality of heat transfer tubes 71*a* to 71*j*. In this case, the swirl preventing sections 75 are in contact with the downstream side outer circumferential surface of the heat transfer tubes 71*a* to 71*j*.

Action and effects achieved by the economizer 70 in this embodiment are explained.

With the economizer 70 in this embodiment, the swirl preventing sections 75 are disposed in contact with the downstream side outer circumferential surfaces in the combustion gas flowing direction of the respective plurality of heat transfer tubes 71*a* to 71*j*. Therefore, a phenomenon in which swirls that facilitate heat transfer occur on the downstream sides of the heat transfer tubes 71*a* to 71*j* when the combustion gas passes through the heat transfer tubes 71*a* to 71*j* is prevented. Therefore, it is possible to reduce a heat absorption amount due to heat transfer of heat of the combustion gas from the downstream side outer circumferential surfaces of the heat transfer tubes 71*a* to 71*j* to fluid such as water or steam flowing in the heat transfer tubes 71*a* to 71*j*.

In the economizer 70 in this embodiment, the disposition interval P of the heat transfer tubes 71*a* to 71*j* is 1.5 times or more the outer diameter D of the heat transfer tubes 71*a* to 71*j*. When the disposition interval P in the combustion gas flowing direction of the plurality of heat transfer tubes 71*a* to 71*j* is 1.5 times or more the outer diameter D of the heat transfer tubes 71*a* to 71*j*, heat transfer between the combustion gas in the heat transfer tubes 71*a* to 71*j* and the fluid flowing in the heat transfer tubes 71*a* to 71*j* is performed mainly as convective heat transfer.

Therefore, a phenomenon in which swirls that facilitate heat transfer occur on the downstream sides in the combustion gas flowing direction of the heat transfer tubes 71*a* to 71*j* when the combustion gas passes through the heat transfer tubes 71*a* to 71*j* is prevented by the plurality of the swirl preventing sections 75. Consequently, it is possible to reduce a heat absorption amount due to heat transfer between the combustion gas and the fluid flowing in the heat transfer tubes 71*a* to 71*j*.

In the economizer 70 in this embodiment, the swirl preventing sections 75 are disposed in contact with the downstream side outer circumferential surfaces in the working range θ of 120° or more and 180° or less centering on the downstream side end portions in the flowing direction of the heat transfer tubes 71*a* to 71*j* in the circumferential directions around the longitudinal direction center axes X of the heat transfer tubes 71*a* to 71*j*.

By setting the range in which the swirl preventing sections 75 are in contact with the downstream side outer circumferential surfaces of the heat transfer tubes 71*a* to 71*j* to 120° or more, the phenomenon in which swirls that facilitate heat transfer occur on the downstream sides in the combustion gas flowing direction of the heat transfer tubes 71*a* to 71*j* when the combustion gas passes through the heat transfer tubes 71*a* to 71*j* is effectively prevented. By setting the range in which the swirl preventing sections 75 is in contact with the downstream side outer circumferential surfaces of the heat transfer tubes 71*a* to 71*j* to 180° or less, it is possible to prevent a heat absorption amount of the economizer 70 from excessively decreasing and prevent a pressure loss at the time when the combustion gas flows from increasing because an interval between the heat transfer tubes 71*a* to 71*j* and the other plurality of heat transfer tubes 71*a* to 71*j* disposed adjacent to the heat transfer tube 71*a* to 71*j* is excessively narrowed.

In the economizer 70 in this embodiment, the swirl preventing section 75 is disposed in contact with both of the downstream side outer circumferential surface 71Aa of the heat transfer tube 71*a* disposed on the upstream side in the combustion gas flowing direction and the upstream side outer circumferential surface 71Bb of the heat transfer tube 71*b* disposed adjacent to the downstream side in the combustion gas flowing direction of the heat transfer tube 71*a*.

Since the swirl preventing section 75 is disposed to fill a gap in the combustion gas flowing direction between the heat transfer tube 71*a* and the heat transfer tube 71*b*, it is possible to set the swirl preventing section 75 with relatively easy setting work.

In the economizer 70 in this embodiment, the swirl preventing section 75 is a fireproof material including at least one of $SiO_2$ and $Al_2O_3$. By using the fireproof material including $SiO_2$ or $Al_2O_3$ excellent in heat resistance and abrasion resistance and generally used, it is possible to form the swirl preventing section 75 with a material relatively inexpensive and having durability against the combustion gas.

The economizer 70 in this embodiment includes the holding sections 76 disposed between pairs of the heat transfer tubes 71*a* to 71*j*, which are disposed adjacent to each other in the combustion gas flowing direction, and configured to hold the fireproof materials. By holding the swirl preventing sections 75, which are the heat proof materials, with the holding sections 76, it is possible to facilitate working of the fireproof materials and prevent the fireproof materials from peeling from the heat transfer tubes because of aged deterioration or the like.

The holding section 76 in this embodiment includes the first bar-like member 76*a* made of metal, both the end portions of which are welded to the pair of heat transfer tubes 71*a* and 71*b* and the second bar-like member 76*b* made of metal welded to the first bar-like member 76*a* and disposed to cross the first bar-like member 76*a*.

By disposing the first bar-like member 76*a* and the second bar-like member 76*b* to cross, it is possible to appropriately hold the fireproof material in a gap between the pair of heat transfer tubes 71*a* and 71*b*. Since both the end portions of the first bar-like member 76*a* are welded to the pair of heat transfer tubes and heat transfer from the first bar-like member 76*a* to the pair of heat transfer tubes 71*a* and 71*b* is possible, it is possible to prevent the holding section 76 from being burned by heat of the combustion gas.

Second Embodiment

A second embodiment of the present invention is explained with reference to the drawings.

This embodiment is a modification of the first embodiment and is the same as the first embodiment except, in particular, the following explanation.

In the economizer 70 in the first embodiment, the swirl preventing section 75 is disposed in contact with both of the downstream side outer circumferential surface 71Aa of the heat transfer tube 71*a* disposed on the upstream side in the combustion gas flowing direction and the upstream side outer circumferential surface 71Bb of the heat transfer tube 71*b* disposed adjacent to the downstream side in the combustion gas flowing direction of the heat transfer tube 71*a*.

An economizer 70A in this embodiment is different from the economizer 70 in the first embodiment in that a swirl preventing section 75A is disposed in contact with the downstream side outer circumferential surface 71Aa of the heat transfer tube 71*a* disposed on the upstream side in the combustion gas flowing direction and, on the other hand, is not in contact with the upstream side outer circumferential surface 71Bb of the heat transfer tube 71*b* disposed adjacent to the downstream side in the combustion gas flowing direction of the heat transfer tube 71*a*.

Figure 8:
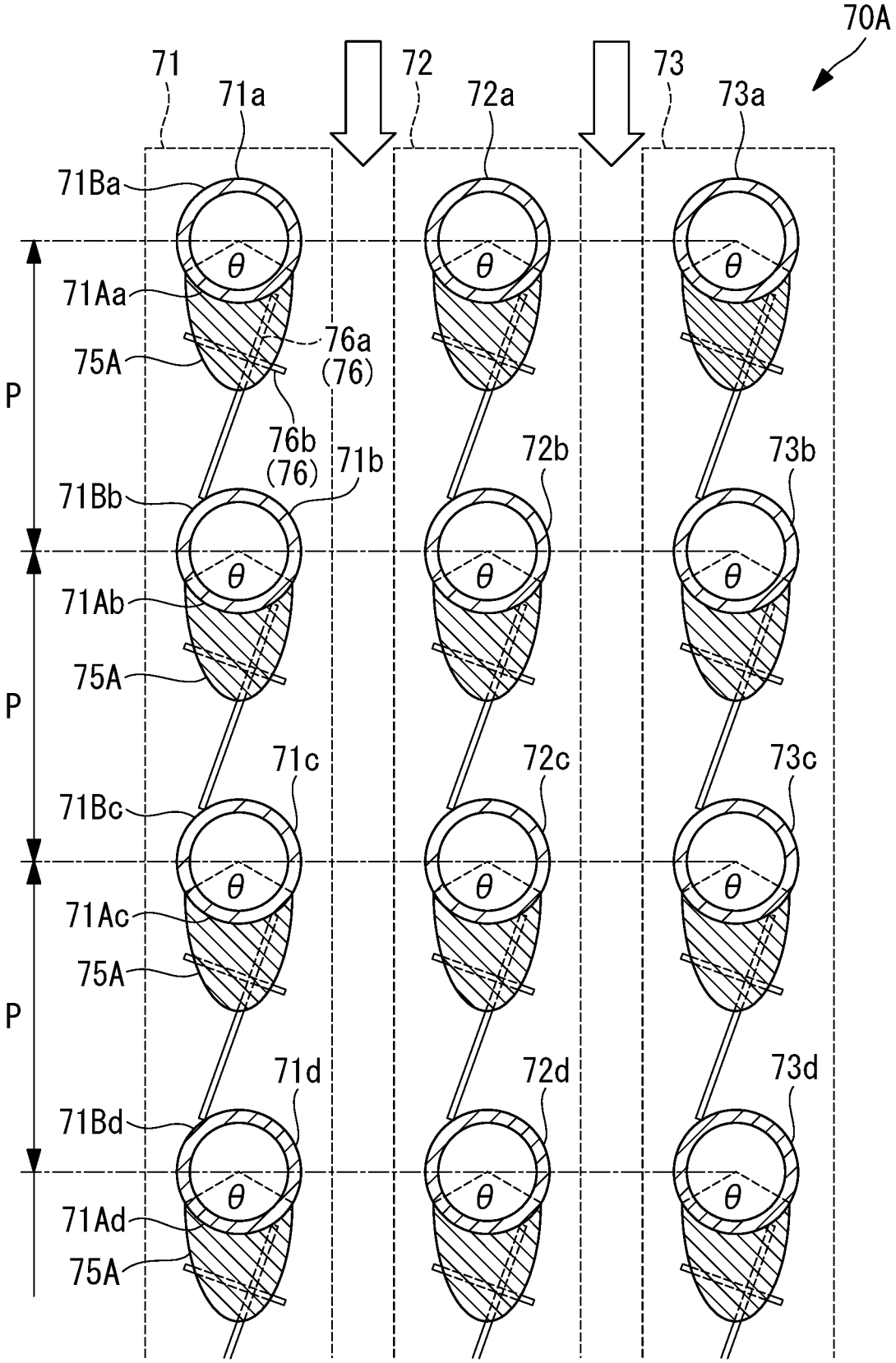
FIG. 8 is a sectional view showing an economizer in a second embodiment.

As shown in FIG. 8, in the economizer 70A in this embodiment, the swirl preventing section 75A is in contact with only the downstream side outer circumferential surface 71Aa of the heat transfer tube 71*a* disposed on the upstream side in the combustion gas flowing direction. The swirl preventing section 75A is not in contact with the upstream side outer circumferential surface 71Bb of the heat transfer tube 71*b* disposed adjacent to the downstream side in the combustion gas flowing direction of the heat transfer tube 71*a*. This is because it is sufficient to set only the swirl preventing section 75A in contact with only the downstream side outer circumferential surface 71Aa of the heat transfer tube 71*a* in order to prevent a swirl that facilitates heat transfer from occurring on the downstream side of the heat transfer tube 71*a* when the combustion gas passes through the heat transfer tube 71*a*.

Even when the gap between the heat transfer tube 71*a* and the heat transfer tube 71*b* disposed adjacent to the downstream side in the combustion gas flowing direction is displaced because of a temperature rise or the like, the swirl preventing section 75A according to this embodiment can prevent interference between the swirl preventing section 75A and the heat transfer tube 71*b*. Therefore, it is possible to prevent the swirl preventing section 75A from peeling from the heat transfer tube 71*a*.

Third Embodiment

A third embodiment of the present invention is explained below with reference to the drawings.

This embodiment is a modification of the first embodiment and the second embodiment and is the same as the first embodiment and the second embodiment except, in particular, the following explanation.

In the first embodiment and the second embodiment, the fireproof material including at least one of $SiO_2$ and $Al_2O_3$ is used as the swirl preventing sections 75 and 75A.

This embodiment is different from the first embodiment and the second embodiment in that a swirl preventing section is a tube body extending in a crossing direction crossing a flowing direction of combustion gas.

Figure 9:
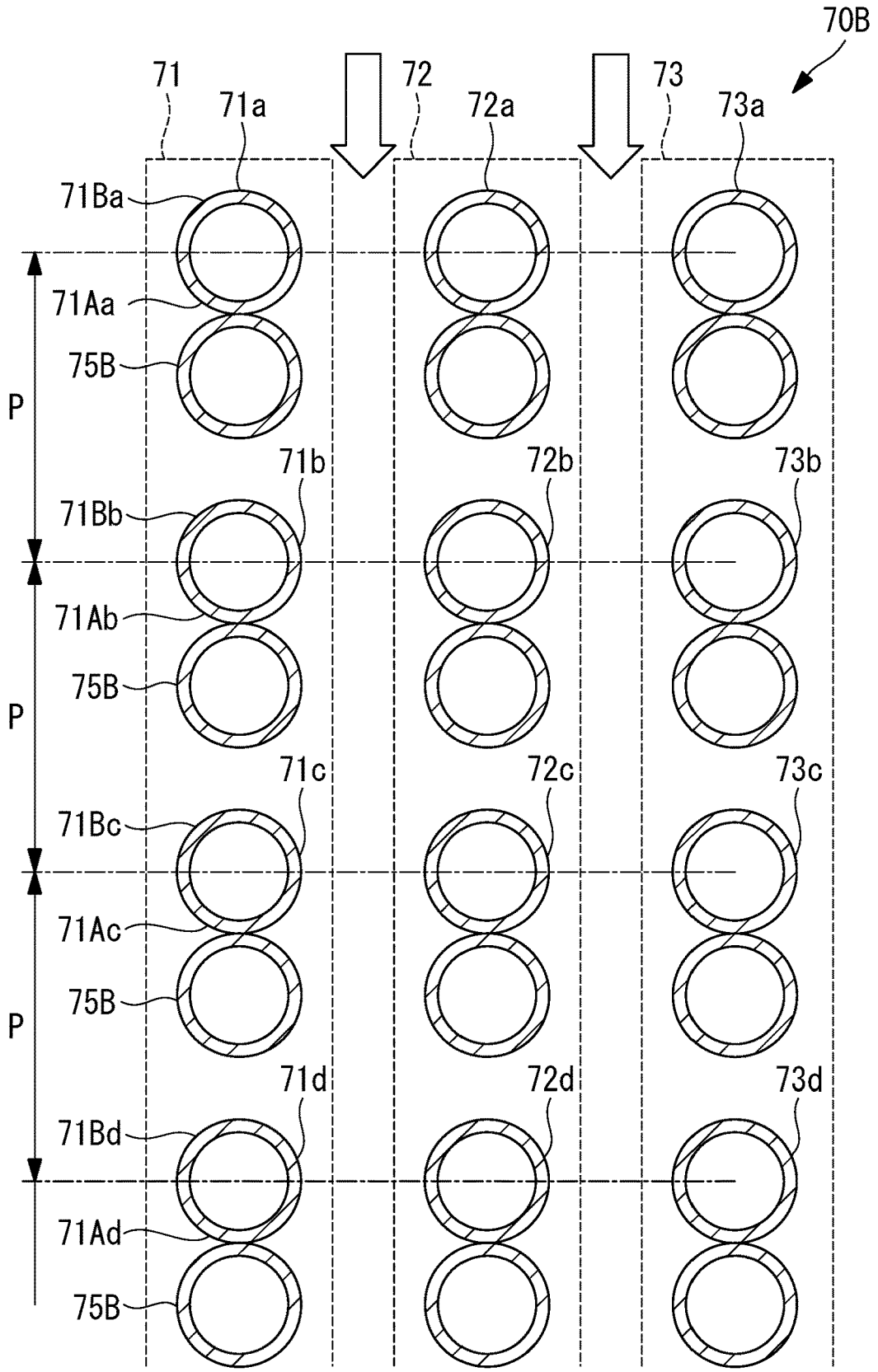
FIG. 9 is a sectional view showing an economizer in a third embodiment.

As shown in FIG. 9, in an economizer 70B in this embodiment, swirl preventing sections 75B are tube bodies extending in the same direction as the longitudinal axial direction of the heat transfer tubes 71*a* to 71*d* along the crossing direction crossing the flowing direction of the combustion gas. The swirl preventing sections 75B are disposed in contact with the downstream side outer circumferential surfaces 71Aa to 71Ad of the respective heat transfer tubes 71*a* to 71*d*.

According to this embodiment, the swirl preventing sections 75B, which are the tube bodies, are disposed in contact with the downstream side outer circumferential surfaces 71Aa to 71Ad in the combustion gas flowing direction of the heat transfer tubes 71*a* to 71*d*. Consequently, a phenomenon in which swirls that facilitate heat transfer occur immediately downstream in the downstream sides in the combustion gas flowing direction of the heat transfer tubes 71*a* to 71*d* when the combustion gas passes through the heat transfer tubes 71*a* to 71*d* is prevented.

Other Embodiments

In the above explanation, the swirl preventing sections 75, 75A, and 75B are provided in the economizers 70, 70A, and 70B. However, other forms may be adopted. For example, swirl preventing sections may be provided in the re-heater 60. Other heat exchangers may be adopted if a plurality of heat transfer tube are disposed at a disposition interval of 1.5 times or more the outer diameter of the heat transfer tubes such that heat transfer is performed mainly as convective heat transfer rather than radiation heat transfer.

The swirl preventing sections 75, 75A, and 75B explained above are particularly effective in reducing a heat absorption amount from the combustion gas without requiring a lot of manhour when the coal-fired boiler is remodeled into the gas-fired boiler. However, other forms may be adopted. For example, the swirl preventing sections 75, 75A, and 75B in this embodiment may be adopted when coal having a heat value per unit weight larger than a heat value in the past is used as coal used in the coal-fired boiler. That is, the present invention is applicable to a boiler other than the gas-fired boiler if the boiler includes a heat exchanger that needs to reduce a heat absorption amount.

REFERENCE SIGNS LIST

10 boiler
20 burner
30 furnace
40 flue
50 superheater
60 re-heater
70, 70A, 70B economizer (heat exchanger)
71, 72, 73 heat transfer tube panel
71*a*, 71*b*, 71*c*, 71*d* heat transfer tube
75, 75A, 75B swirl preventing section
76 holding section (stud)
76*a* first bar-like member
76*b* second bar-like member

The invention claimed is:

1. A heat exchanger comprising:

a plurality of cylindrical heat transfer tubes extending in a direction which crosses a flowing direction of a combustion gas, the plurality of heat transfer tubes being disposed at a predetermined disposition interval along the flowing direction, such that heat exchange is performed between a fluid flowing in the plurality of heat transfer tubes and the combustion gas; and a swirl preventing section disposed in contact with a downstream side outer circumferential surface, relative to the flowing direction, of each of the plurality of heat transfer tubes and configured to prevent a swirl of the combustion gas from occurring near the downstream side outer circumferential surface, the swirl preventing section being disposed in contact with the downstream side outer circumferential surface in a range of 120° or more and 180° or less along the downstream side outer circumferential surface.

2. The heat exchanger according to claim 1, wherein the predetermined disposition interval is 1.5 times or more an outer diameter of one of the heat transfer tubes.

3. The heat exchanger according to claim 1, wherein the swirl preventing section includes a fireproof material including at least any one of $SiO_2$, $Al_2O_3$, and SiC.

4. The heat exchanger according to claim 3, further comprising a holding section configured to hold the fireproof material, the holding section being disposed between a pair of the heat transfer tubes, the pair of the heat transfer tubes being adjacent to each other in the flowing direction.

5. The heat exchanger according to claim 1, wherein the swirl preventing section is a tube body extending in a longitudinal axial direction of the heat transfer tubes so as to cross the flowing direction of the combustion gas.

6. A heat exchanger comprising:

a plurality of cylindrical heat transfer tubes extending in a direction which crosses a flowing direction of a combustion gas, the plurality of heat transfer tubes being disposed at a predetermined disposition interval along the flowing direction, such that heat exchange is performed between a fluid flowing in the plurality of heat transfer tubes and the combustion gas; and a swirl preventing section disposed in contact with a downstream side outer circumferential surface, relative to the flowing direction, of each of the plurality of heat transfer tubes and configured to prevent a swirl of the combustion gas from occurring near the downstream side outer circumferential surface, wherein the swirl preventing section is disposed in contact with both the downstream side outer circumferential surface of a first heat transfer tube among the heat transfer tubes, and an upstream side outer circumferential surface, relative to the flowing direction, of a second heat transfer tube among the heat transfer tubes, the second heat transfer tube being disposed adjacent to the first heat transfer tube on a downstream side of the first heat transfer tube in the flowing direction.

7. A heat exchanger comprising:

a plurality of cylindrical heat transfer tubes extending in a direction which crosses a flowing direction of a combustion gas, the plurality of heat transfer tubes being disposed at a predetermined disposition interval along the flowing direction, such that heat exchange is performed between a fluid flowing in the plurality of heat transfer tubes and the combustion gas;

a swirl preventing section disposed in contact with a downstream side outer circumferential surface, relative to the flowing direction, of each of the plurality of heat transfer tubes and configured to prevent a swirl of the combustion gas from occurring near the downstream side outer circumferential surface; and a holding section disposed between a pair of the heat transfer tubes, the pair of the heat transfer tubes being adjacent to each other in the flowing direction, wherein the swirl preventing section includes a fireproof material including at least any one of $SiO_2$, $Al_2O_3$, and SiC, and the holding section is configured to hold the fireproof material, and wherein the holding section includes a first bar-like member made of metal, both end portions of which are welded to the pair of heat transfer tubes, and a second bar-like member made of metal welded to the first bar-like member and disposed to cross the first bar-like member.

8. A boiler comprising a heat exchanger that performs heat exchange with combustion gas generated in a furnace, wherein the heat exchanger includes:

a plurality of cylindrical heat transfer tubes extending in a direction which crosses a flowing direction of a combustion gas, the plurality of heat transfer tubes being disposed at a predetermined disposition interval along the flowing direction, such that heat exchange is performed between a fluid flowing in the plurality of heat transfer tubes and the combustion gas; and a swirl preventing section disposed in contact with a downstream side outer circumferential surface, relative to the flowing direction, of each of the plurality of heat transfer tubes and configured to prevent a swirl of the combustion gas from occurring near the downstream side outer circumferential surface, the swirl preventing section being disposed in contact with the downstream side outer circumferential surface in a range of 120° or more and 180° or less along the downstream side outer circumferential surface.

9. A setting method for a heat exchanger, comprising:

disposing a plurality of cylindrical heat transfer tubes at a predetermined disposition interval along a flowing direction of a combustion gas, the plurality of cylindrical heat transfer tubes extending in a direction which crosses the flowing direction of the combustion gas, such that heat exchange is performed between a fluid flowing in the plurality of heat transfer tubes and the combustion gas; and disposing a swirl preventing section so as to be in contact with a downstream side outer circumferential surface, relative to the flowing direction, of each of the plurality of heat transfer tubes, the swirl preventing section being configured to prevent a swirl of the combustion gas from occurring near the downstream side outer circumferential surface, the swirl preventing section being disposed in contact with the downstream side outer circumferential surface in a range of 120° or more and 180° or less along the downstream side outer circumferential surface.

* * * * *